US010920167B2

(12) United States Patent
Katsuno et al.

(10) Patent No.: US 10,920,167 B2
(45) Date of Patent: Feb. 16, 2021

(54) LUBRICANT COMPOSITION AND LUBRICATING OIL COMPOSITION

(71) Applicant: ADEKA CORPORATION, Tokyo (JP)

(72) Inventors: Eiji Katsuno, Tokyo (JP); Taro Sumi, Tokyo (JP)

(73) Assignee: ADEKA CORPORATION, Tokyo (JP)

( * ) Notice: Subject to any disclaimer, the term of this patent is extended or adjusted under 35 U.S.C. 154(b) by 182 days.

(21) Appl. No.: 16/314,918

(22) PCT Filed: Jun. 26, 2017

(86) PCT No.: PCT/JP2017/023418
§ 371 (c)(1),
(2) Date: Jan. 3, 2019

(87) PCT Pub. No.: WO2018/012265
PCT Pub. Date: Jan. 18, 2018

(65) Prior Publication Data

US 2019/0169527 A1 Jun. 6, 2019

(30) Foreign Application Priority Data

Jul. 11, 2016 (JP) ..... 2016-136716

(51) Int. Cl.

| | |
|---|---|
| ***C10M 169/04*** | (2006.01) |
| ***C10M 139/00*** | (2006.01) |
| ***C10M 135/12*** | (2006.01) |
| ***C10M 135/18*** | (2006.01) |
| *C10N 10/12* | (2006.01) |
| *C10N 30/02* | (2006.01) |
| *C10N 30/06* | (2006.01) |
| *C10N 30/10* | (2006.01) |
| *C10N 40/25* | (2006.01) |

(52) U.S. Cl.
CPC ..... *C10M 169/04* (2013.01); *C10M 135/12* (2013.01); *C10M 135/18* (2013.01); *C10M 139/00* (2013.01); *C10M 2227/066* (2013.01); *C10N 2010/12* (2013.01); *C10N 2030/02* (2013.01); *C10N 2030/06* (2013.01); *C10N 2030/10* (2013.01); *C10N 2040/255* (2020.05)

(58) Field of Classification Search
CPC ..... C10M 169/04; C10M 135/12; C10M 135/18; C10M 139/00; C10M 2227/066; C10M 2203/1025; C10M 2219/068; C10N 2010/12; C10N 2030/02; C10N 2030/06; C10N 2030/10; C10N 2040/255; C10N 2040/252; C10N 2040/135; C10N 2030/70; C10N 2040/04; C10N 2040/02
USPC ..... 508/335
See application file for complete search history.

(56) References Cited

U.S. PATENT DOCUMENTS

| | | | | |
|---|---|---|---|---|
| 6,074,993 | A | 6/2000 | Waddoups et al. | |
| 6,232,276 | B1 * | 5/2001 | Stiefel | C10M 135/18 508/363 |
| 2011/0237474 | A1 * | 9/2011 | Mazzamaro | C10M 141/12 508/364 |

FOREIGN PATENT DOCUMENTS

| | | |
|---|---|---|
| JP | 05-062639 | 3/1993 |
| JP | 11-269477 | 10/1999 |
| JP | 2001-207185 | 7/2001 |
| JP | 2002-506920 | 3/2002 |
| JP | 2003-513150 | 4/2003 |
| JP | 2004-143273 | 5/2004 |
| JP | 2007-505168 | 3/2007 |
| JP | 2007-197614 | 8/2007 |
| JP | 2008-106199 | 5/2008 |
| JP | 2008-150579 | 7/2008 |
| JP | 2012-111803 | 6/2012 |
| WO | 2014/021350 | 2/2014 |
| WO | 2017/002969 | 1/2017 |

OTHER PUBLICATIONS

Xin Zhang et al., "Application of Tri-Nuclear Organic Molybdenum Complex Lubricating Addictive in Diesel Engine", China Molybdenum Industry, vol. 39, No. 6, pp. 10-13, 2015, with English abstract.

International Search Report dated Aug. 1, 2017 in International (PCT) Application No. PCT/JP2017/023418.

* cited by examiner

*Primary Examiner* — Prem C Singh
*Assistant Examiner* — Francis C Campanell
(74) *Attorney, Agent, or Firm* — Wenderoth, Lind & Ponack, L.L.P.

(57) ABSTRACT

A lubricant composition including a binuclear molybdenum compound (A) and a trinuclear molybdenum compound (B), wherein these compounds are included in a range represented by (molybdenum of the binuclear molybdenum compound (A)):(molybdenum of the trinuclear molybdenum compound (B))=99.98:0.02 to 95:5 as a mass ratio.

3 Claims, 1 Drawing Sheet

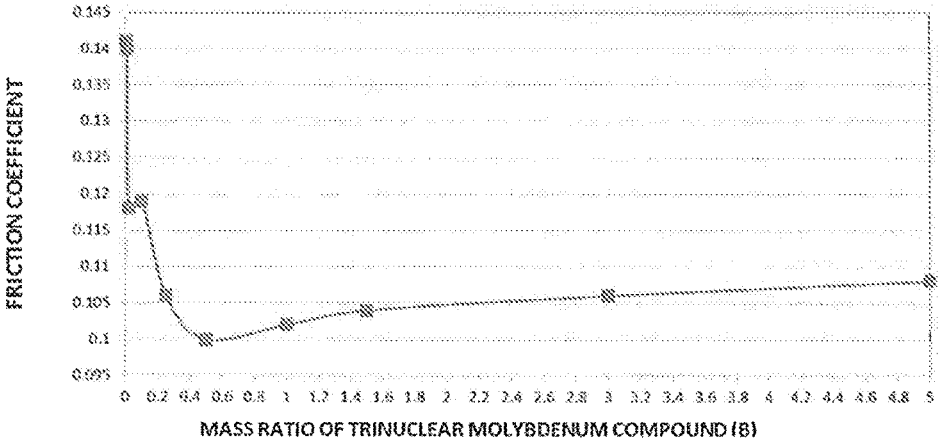
RELATIONSHIP BETWEEN MASS RATIO OF MOLYBDENUM OF TRINUCLEAR MOLYBDENUM COMPOUND (B) AND FRICTION COEFFICIENT

LUBRICANT COMPOSITION AND LUBRICATING OIL COMPOSITION

TECHNICAL FIELD

This invention relates to a lubricant composition and a lubricating oil composition. More specifically, this invention relates to a lubricant composition exhibiting good friction reducing effects, good solubility in a base oil and good oxidation stability when used as an additive for a lubricating oil, and a lubricating oil composition including such a lubricant composition.

BACKGROUND ART

Organomolybdenum compounds well known in the field of lubricating oils can be exemplified by molybdenum dithiocarbamates, molybdenum dithiophosphates, molybdenum amines and the like. These organomolybdenum compounds have been conventionally used on various occasions as additives for improving lubricating performance (Patent Documents 1 to 3).

Among these, binuclear molybdenum dithiocarbamates are well known as additives showing good friction reducing properties in a "boundary lubrication region" or "mixed lubrication region" where the sliding surfaces of two parts in a machine are in direct contact. For this reason, these compounds are widely used in various applications such as additives for engine oils, additives for hydraulic fluids and additives for greases (Patent Documents 4 to 6), but demands for improved friction reducing properties have been growing year by year in every field, and development of additives that meet this demand is required.

Meanwhile, molybdenum dithiocarbamates are also known to have a trinuclear modification. Similar to binuclear molybdenum dithiocarbamates, trinuclear molybdenum dithiocarbamates are also known to be used as additives for lubricating oils. For example, Patent Document 7 discloses "a lubricating oil composition exhibiting improved fuel economy and fuel economy retention properties which comprises an oil of lubricating viscosity including (a) 0.3% by mass to 6% by mass of an oil-soluble overbased calcium detergent additive and (b) an oil-soluble trinuclear molybdenum compound of a general formula $Mo_3S_kL_n$ (where k is 4 to 10, n is 1 to 4 and L is an organic ligand having sufficient carbon atoms to reader the trinuclear molybdenum compound oil soluble, or which is produced by mixing the aforementioned components, wherein said compound is present in such an amount as to provide 10 mass ppm to 1000 mass ppm molybdenum in the composition". Patent Document 8 discloses "a lubricating oil composition which has less than 2000 ppm sulfur and is substantially free of zinc and phosphorus, the lubricating oil composition comprising: a major amount of a base oil of lubricating viscosity and an additive system including: (i) a metal detergent or a mixture of metal detergents; (ii) an ashless dispersant or a mixture of dispersants, at least one of which is a borated ashless dispersant; (iii) an ashless aminic antioxidant or a mixture of antioxidants including at least one aminic antioxidant; and (iv) an oil-soluble, phosphorous-free trinuclear molybdenum compound". However, since trinuclear molybdenum dithiocarbamate has extremely low solubility in base oils and poor oxidation stability, there are many restrictions on the addition to oil and use therewith, and this additive is difficult to use unless other additives such as dispersants are used in conjunction therewith. In addition, the friction reducing effects of trinuclear molybdenum dithiocarbamates are almost equal to that of binuclear molybdenum dithiocarbamates, and the performance desired by users has not been reached.

It is also known to use a combination of binuclear molybdenum dithiocarbamate and a trinuclear molybdenum dithiocarbamate as an additive for lubricating oils. For example, Patent Document 9 discloses "a lubricating oil composition which exhibits improved fuel economy and wet clutch friction properties, said composition comprising: a) an oil of lubricating viscosity; b) at least one overbased calcium or magnesium detergent; c) an oil-soluble dimeric molybdenum compound present in such amount so as to provide up to 2000 ppm Mo in the composition; d) an oil-soluble trinuclear molybdenum compound present in such amount so as to provide up to 350 ppm Mo in the composition; e) at least one oil-soluble organic friction modifier; and f) at least one zinc dihydrocarbyldithiophosphate compound, wherein said composition has a TBN of at least 3.6 attributable to said overbased calcium or magnesium detergent, a NOACK volatility of about 15% by mass or less and phosphorus in an amount up to about 0.1% by mass from the zinc dihydrocarbyldithiophosphate compound". However, the friction reducing effects required by users cannot be obtained even with the techniques disclosed in this patent document. As mentioned above, since trinuclear molybdenum dithiocarbamate has poor solubility in a base oil and oxidation stability, trinuclear molybdenum dithiocarbamate is difficult to use as an additive for lubricating oils unless other additives such as a dispersant are used in combination therewith.

Concerning recently developed additives for engine oils, the solubility of the additive itself in the base oil is an essential condition. Additives with low solubility in base oils can be used after being dispersed with other additives, but they are not actively used. Therefore, from the market standpoint, it is strongly desired to develop an additive for lubricating oil which is superior to conventional friction reducing agents in friction reducing effect and has good solubility in a base oil and oxidation stability.

CITATION LIST

Patent Document

[Patent Document 1] Japanese Patent Application Publication No. H11-269477

[Patent Document 2] Japanese Patent Application Publication No. 2007-197614

[Patent Document 3] Japanese Examined Patent Publication No. H05-062639

[Patent Document 4] Japanese Patent Application Publication No. 2012-11180

[Patent Document 5] Japanese Patent Application Publication No. 2008-106199

[Patent Document 6] Japanese Patent Application Publication No. 2004-143273

[Patent Document 7] Japanese Translation of PCT Application Publication No. 2002-506920

[Patent Document 8] Japanese Translation of PCT Application Publication No. 2007-505168

[Patent Document 9] Japanese Translation of PCT Application Publication No. 2003-513150

SUMMARY OF INVENTION

Technical Problem

Therefore, a problem to be resolved by the present invention is to provide a lubricant composition exhibiting good solubility in a base oil, good oxidation stability, and good friction reducing effects.

Solution to Problem

The inventors of the present invention have conducted intensive research and accomplished the present invention. That is, the present invention relates to a lubricant composition comprising a binuclear molybdenum compound (A) and a trinuclear molybdenum compound (B), wherein these compounds are included in a range represented by (molybdenum of the binuclear molybdenum compound (A)):(molybdenum of the trinuclear molybdenum compound (B))=99.98:0.02 to 95:5 as a mass ratio.

Advantageous Effects of Invention

By adjusting the mass ratio of the binuclear molybdenum compound and the trinuclear molybdenum compound to a specific range, it is possible to improve the solubility of the lubricant composition including these compounds in the base oil, the oxidation stability in the lubricating oil composition and the lubricating performance of the lubricating oil composition. That is, the present invention can provide a lubricant composition which is an excellent additive for a lubricating oil composition.

BRIEF DESCRIPTION OF THE DRAWING

FIG. 1 is a diagram showing a relationship between a mass ratio of molybdenum of the trinuclear molybdenum compound (B) and a friction coefficient.

DESCRIPTION OF EMBODIMENTS

The lubricant composition of the present invention includes a binuclear molybdenum compound (A) and a trinuclear molybdenum compound (B), wherein these compounds are included in a range represented by (molybdenum of the binuclear molybdenum compound (A)):(molybdenum of the trinuclear molybdenum compound (B))=99.98:0.02 to 95:5 as a mass ratio.

The binuclear molybdenum compound (A) used in the present invention is not particularly limited as long as it is a binuclear molybdenum compound which can be used in the field of lubricating oils, but from the viewpoint of easily obtaining the effect of the present invention a compound represented by a general formula (1) hereinbelow is preferable:

$$Mo_2S_yO_zL_w \quad (1)$$

(wherein L represents an organic acid, y represents a number from 0 to 4, z represents a number from 0 to 4, y+z=4, and w represents number 1 or 2).

In the general formula (1), L represents an organic acid. Examples of such an acid include a dithiocarbamic acid (dithiocarbamate) having two hydrocarbon groups, dithiophosphoric acid (dithiophosphate) having two hydrocarbon groups, a phosphoric acid (phosphate) having two hydrocarbon groups, a xanthogenic acid having one hydrocarbon group, carboxylic acid (carboxylate) having one hydrocarbon group, and the like. Among these, from the viewpoint of easily obtaining the effect of the present invention, a dithiocarbamic acid (dithiocarbamate) having two hydrocarbon groups and a dithiophosphoric acid (dithiophosphate) having two hydrocarbon groups are preferable, and a dithiocarbamic acid (dithiocarbamate) having two hydrocarbon groups is most preferable. It is to be noted that L is present in a state bonded or coordinated to binuclear molybdenum.

The total number of carbon atoms of the hydrocarbon groups contained in the organic acid determines the oil solubility of the compound represented by the general formula (1). Specifically, the total number of carbon atoms contained in one organic acid is 3 to 100, and in order to exhibit oil solubility suitable for an additive for a lubricating oil, it is preferable that the total number of carbon atoms contained in one organic acid be 3 to 80, more preferably to 50, even more preferably is to 30, and most preferably 17 to 27. Where the total number of carbon atoms contained in one organic acid is less than 3, the additive is unlikely to dissolve in oil, and where the total number of carbon atoms exceeds 100, the additive crystallizes or thickens and can be difficult to handle when used as an additive for lubricating oil.

Further, y represents a number from 0 to 4. Among these numbers, in order to realize, a compound represented by the general formula (1) which makes it possible to easily obtain the effects of the present invention, y is preferably 1 to 3 and most preferably 2.

Furthermore, z represents a number from 0 to 4. Among these numbers, in order to realize a compound represented by the general formula (1) which makes it possible to easily obtain the effects of the present invention, z is preferably 1 to 3 and most preferably 2. The relationship between y and z is y+z=4.

Further, w represents number 1 or 2. Among these numbers, in order to realize a compound represented by the general formula (1) which makes it possible to obtain easily the effect of the present invention, w is preferably 2. When w=2, L in general formula (1) may be the same organic acid or different organic acids. For example, when each of two L (L' and L") has two hydrocarbon groups (hydrocarbon groups in L' are denoted by R' and R", and hydrocarbon groups in L" are denoted by R'" and R""), R', R", R'" and R"" are not limited and may be any combination of hydrocarbon groups. However, from the viewpoint of easily obtaining the effect of the present invention, it is preferable that. R'=R"=R'"=R"" or that R'=R", R'"=R"" and R'≠R'", and mixtures thereof may be used.

Furthermore, from the viewpoint of easily obtaining the effect of the present invention, it is preferable that the binuclear molybdenum compound (A) used in the present invention be a molybdenum dithiocarbamate represented by the following general formula (2):

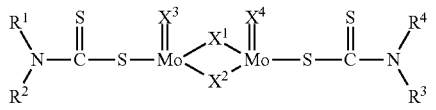

(2)

(wherein $R^1$ to $R^4$ each independently represent a hydrocarbon group having 4 to 18 carbon atoms, and $X^1$ to $X^4$ each independently represent a sulfur atom or an oxygen atom).

In the general formula (2), $R^1$ to $R^4$ each independently represent a hydrocarbon group having 4 to 18 carbon atoms, and examples of such a group include a saturated aliphatic hydrocarbon group such as an n-butyl group, an isobutyl group, an s-butyl group, a t-butyl group, an n-pentyl group, a branched pentyl group, a secondary pentyl group, a tertiary pentyl group, an n-hexyl group, a branched hexyl group, a secondary hexyl group, a tertiary hexyl group, an n-heptyl group, a branched heptyl group, a secondary heptyl group, a tertiary heptyl group, an n-octyl group, a 2-ethylhexyl group, a branched octyl group, a secondary octyl group, a tertiary octyl group, an n-nonyl group, a branched nonyl group, a secondary nonyl group, a tertiary nonyl group, an n-decyl group, a branched decyl group, a secondary decyl group, a tertiary decyl group, an n-undecyl group, a branched undecyl group, a secondary undecyl group, a tertiary undecyl group, an n-dodecyl group, a branched dodecyl group, a secondary dodecyl group, a tertiary dodecyl group, an n-tridecyl group, a branched tridecyl group, a secondary tridecyl group, a tertiary tridecyl group, an n-tetradecyl group, a branched tetradecyl group, a secondary tetradecyl group, a tertiary tetradecyl group, an n-pentadecyl group, a branched pentadecyl group, a secondary pentadecyl group, a tertiary pentadecyl group, an n-hexadecyl group, a branched hexadecyl group, a secondary hexadecyl group, a tertiary hexadecyl group, an n-heptadecyl group, a branched heptadecyl group, a secondary heptadecyl group, a tertiary heptadecyl group, an n-octadecyl group, a branched octadecyl group, a secondary octadecyl group, and a tertiary octadecyl group; an unsaturated aliphatic hydrocarbon group such as a 1-butenyl group, a 2-butenyl group, a 3-butenyl group, a 1-methyl-2-propenyl group, a 2-methyl-2-propenyl group, a 1-pentenyl group, a 2-pentenyl group, a 3-pentenyl group, a 4-pentenyl group, a 1-methyl-2-butenyl group, a 2-methyl-2-butenyl group, a 1-hexenyl group, a 2-hexenyl group, a 3-hexenyl group, a 4-hexenyl group, a 5-hexenyl group, a 1-heptenyl group, a 6-heptenyl group, a 1-octenyl group, a 7-octenyl group, an 8-nonenyl group, a 1-decenyl group, a 9-decenyl group, a 10-undecenyl group, a 1-dodecenyl group, a 4-dodecenyl group, an 11-dodecenyl group, a 12-tridecenyl group, a 13-tetradecenyl group, a 14-pentadecenyl group, a 15-hexadecenyl group, a 16-heptadecenyl group, a 1-octadecenyl group, and a 17-octadecenyl group; an aromatic hydrocarbon group such as a phenyl group, a toluyl group, a xylyl group, a cumenyl group, a mesityl group, a benzyl group, a phenethyl group, a styryl group, a cinnamyl group, a benzhydryl group, a trityl group, an ethylphenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, a dodecylphenyl group, a styrenated phenyl group, a p-cumylphenyl group, a phenylphenyl group, a benzylphenyl group, an α-naphthyl group, and a β-naphthyl group; and an alicyclic hydrocarbon group such as a cyclopropyl group, a cyclobutyl group, a cyclopentyl group, a cyclohexyl group, a cycloheptyl group, a cyclooctyl group, a methylcyclopentyl group, a methylcyclohexyl group, a methylcycloheptyl group, a methylcyclooctyl group, a 4,4,6,6-tetramethylcyclohexyl group, a 1,3-dibutylcyclohexyl group, a norbornyl group, a bicyclo[2.2.2]octyl group, an adamantyl group, a 1-cyclobutenyl group, a 1-cyclopentenyl group, a 3-cyclopentenyl group, a 1-cyclohexenyl group, a 3-cyclohexenyl group, a 3-cycloheptenyl group, a 4-cyclooctenyl group, a 2-methyl-3-cyclohexenyl group, and a 3,4-dimethyl-3-cyclohexenyl group. $R^1$ to $R^4$ may be the same or different from each other. Among these, saturated aliphatic hydrocarbon groups and unsaturated aliphatic hydrocarbon groups are preferable, and saturated aliphatic hydrocarbon groups are more preferable because the effect of the present invention can be more easily obtained. Further, a saturated aliphatic hydrocarbon group having 6 to 15 carbon atoms is more preferable, a saturated aliphatic hydrocarbon group having 8 to 13 carbon atoms is even more preferable, saturated aliphatic hydrocarbon groups having 8 and 13 carbon atoms are most preferable because the effect of the present invention is more easily obtained and the production is facilitated. In particular, a 2-ethylhexyl group is preferable as the saturated aliphatic hydrocarbon group having 8 carbon atoms. Also, a branched tridecyl group is preferable as the saturated aliphatic hydrocarbon group having 13 carbon atoms.

In the case where $R^1$ to $R^4$ of the general formula (2) are constituted by two or more types of hydrocarbon groups, several molybdenum dithiocarbamates represented by the general formula (2) are mixed. From the viewpoint of more remarkably demonstrating the effect of the present invention, R to $R^4$ of the general formula (2) are preferably constituted by two types of hydrocarbon groups, a mixture of compounds represented by the general formula (2) in which the groups bonded to the same nitrogen are the same hydrocarbon groups (for example, a molybdenum dithiocarbamate represented by the general formula (2) in which $R^1=R^2=R^3=R^4$ and a molybdenum dithiocarbamate represented by the general formula (2) in which $R^1=R^2$, $R^3=R^4$, and $R^1 \neq R^3$) is more preferable, and a mixture of compounds represented by the general formula (2) in which the groups bonded to the same nitrogen are the same hydrocarbon groups and $R^1$ to $R^4$ are each a saturated aliphatic hydrocarbon group having 8 carbon atoms or a saturated aliphatic hydrocarbon group having 13 carbon atoms (a molybdenum dithiocarbamate represented by the general formula (2) in which all of $R^1$ to $R^4$ are each a saturated aliphatic hydrocarbon group having 8 carbon atoms, a molybdenum dithiocarbamate represented by the general formula (2) in which all of $R^1$ to $R^4$ are each a saturated aliphatic hydrocarbon group having 13 carbon atoms, and a molybdenum dithiocarbamate represented by the general formula (2) in which $R^1$ and $R^2$ are each a saturated aliphatic hydrocarbon group having 8 carbon atoms and $R^3$ and $R^4$ are each a saturated aliphatic hydrocarbon group having 13 carbon atoms) is even more preferable. Specifically, in the mixture, the saturated aliphatic hydrocarbon group having 8 carbon atoms is preferably a 2-ethylhexyl group, and the saturated aliphatic hydrocarbon group having 13 carbon atoms is preferably a branched tridecyl group. For example, a mixture of compounds of (A)-1, (A)-2 and (A)-3 in the following Examples is preferable.

The mixing ratio of several molybdenum dithiocarbamates mixed together when $R^1$ to $R^4$ of the general formula (2) are constituted by two or more types of groups is not limited, but among them, from the viewpoint of remarkably demonstrating the effect of the present invention, it is preferable that mixing be performed at a mass ratio of (the amount of Mo in the molybdenum dithiocarbamate represented by the general formula (2) in which $R^1=R^2=R^3=R^4$):(the amount of Mo in the molybdenum dithiocarbamate represented by the general formula (2) in which $R^1=R^2$, $R^3=R^4$, $R^1 \neq R^3$):(the amount of Mo in the molybdenum dithiocarbamate represented by the general formula (2) in which hydrocarbon groups bonded to the same nitrogen are different hydrocarbon groups)=(20 to 80):(20 to 80):0, more preferably (40 to 60):(40 to 60):0, and even more preferably (45 to 55) (45 to 55):0. The sum of the numerical values of the constituent components of the proportional equation is 100.

Furthermore, when $R^1$ to $R^4$ in the general formula (2) each are a saturated aliphatic hydrocarbon group having carbon atoms and a saturated aliphatic hydrocarbon group having 13 carbon atoms, from the viewpoint of more remarkably demonstrating the effect of the present invention, the mixing ratio of several types of mixed dithiocarbamates is preferably (the amount of Mo in the molybdenum dithiocarbamate represented by the general formula (2) in which all of $R^1$ to $R^4$ are saturated aliphatic hydrocarbon groups having 8 carbon atoms):(the amount of Mo in the molybdenum dithiocarbamate represented by the general formula (2) in which $R^1$ and $R^2$ each are a saturated aliphatic hydrocarbon group having 8 carbon atoms and $R^3$ and $R^4$ each are a saturated aliphatic hydrocarbon group having 13 carbon atoms):(the amount of Mo in the molybdenum dithiocarbamate represented by the general formula (2) in which $R^1$ to $R^4$ each are a saturated aliphatic hydrocarbon group having 13 carbon atoms) (the amount of Mo in the molybdenum dithiocarbamate represented by the general formula (2) in which hydrocarbon groups bonded to the same nitrogen are different hydrocarbon groups)=(10 to 40):(20 to 80):(10 to 40):0, more preferably (20 to 30):(40 to 60):(20 to 30):0, and even more preferably (22 to 27):(45 to 55):(22 to 27):0. The sum of the numerical values of the constituent components of the proportional equation is 100. Further, mixing is preferably performed so that the mass ratio of (the amount of Mo in the compound (A)-1 in the Examples):(the amount of Mo in the compound (A)-3 in the Examples):(the amount of Mo in the compound (A)-2 in the Examples) is (10 to 40):(20 to 80):(10 to 40), more preferably (20 to 30):(40 to 60):(20 to 30), and even more preferably (22 to 27):(45 to 55):(22 to 27). The sum of the numerical values of the constituent components of the proportional equation is 100.

In the general formula (2), $X^1$ to $X^4$ each independently represent a sulfur atom or an oxygen atom. Among them, from the viewpoint of easily obtaining the effects of the present invention, it is preferable that $X^1$ and $X^2$ each be a sulfur atom, and it is more preferable that $X^1$ and $X^2$ each be a sulfur atom and $X^3$ and $X^4$ each be an oxygen atom.

Further, the molybdenum dithiocarbamates represented by the general formula (2) which are used in the present invention can be produced by a known production method.

The trinuclear molybdenum compound (B) used in the present invention is not particularly limited as long as it is a trinuclear molybdenum compound that can be used in the field of lubricating oils, but from the viewpoint of easily obtaining the effects of the present invention, a compound represented by the following general formula (3) is preferable:

$$Mo_3S_kQ_m \tag{3}$$

(wherein Q represents an organic acid, k represents a number from 3 to 10, and m represents a number from 1 to 4).

In the general formula (3), Q represents an organic acid, and this group can be exemplified by a dithiocarbamic acid (dithiocarbamate) having two hydrocarbon groups, a dithiophosphoric acid (dithiophosphate) having two hydrocarbon groups, a phosphoric acid (phosphate) having a two hydrocarbon groups, a xanthogenic acid having one hydrocarbon group, a carboxylic acid (carboxylate) having one hydrocarbon group, and the like. Among these, from the viewpoint of easily obtaining the effects of the present invention, a dithiocarbamic acid (dithiocarbamate) having two hydrocarbon groups and a dithiophosphoric acid (dithiophosphate) having two hydrocarbon groups are preferable, and a dithiocarbamic acid (dithiocarbamate) having two hydrocarbon groups is most preferable. It is to be noted that Q is present in a state bonded or coordinated to trinuclear molybdenum.

The total number of carbon atoms of the hydrocarbon groups contained in the organic acid influences the effects of the present invention. Specifically, the total number of carbon atoms contained in one organic acid is 3 to 100, and from the viewpoint of more remarkably demonstrating the effects of the present invention, it is preferable that the total number of carbon atoms contained in one organic acid be 3 to 80, more preferably 8 to 50, even more preferably 15 to 30, and most preferably 17 to 27. Where the total number of carbon atoms contained in one organic acid is less than 3, the effects of the present invention are sometimes unlikely to be obtained, and where the total number of carbon atoms contained in one organic acid is more than 100, the effects of the present invention are sometimes also unlikely to be obtained.

Further, k represents a number from 3 to 10. Among these numbers, in order to realize a compound represented by the general formula (3) which makes it possible to easily obtain the effects of the present invention, k is preferably 4 to 7 and most preferably 7.

m represents a number from 1 to 4. Among these numbers, in order to realize a compound represented by the general formula (3) which makes it possible to easily obtain the effects of the present invention, m is preferably 3 or 4 and most preferably 4.

When m is 2 or more, Q in the general formula (3) may be the same organic acid group or different organic acid groups. Further, from the viewpoint of more remarkably demonstrating the effects of the present invention, Q is preferably constituted by the same organic acid as the L in the binuclear molybdenum compound represented by the general formula (1) to be used in combination.

Furthermore, from the viewpoint of easily obtaining the effects of the present invention, the trinuclear Molybdenum compound (B) used in the present invention is preferably a compound represented by the following general formula (4):

$$Mo_3S_h(\overset{\overset{\displaystyle S}{\|}}{C}NR^5R^6)_n \tag{4}$$

(wherein $R^5$ and $R^6$ each independently represent a hydrocarbon group having 4 to 18 carbon atoms, h represents a number from 3 to 10, and n represents a number from 1 to 4), In the general formula (4), $R^5$ and $R^6$ each independently represent a hydrocarbon group having 4 to 18 carbon atoms, and examples of such a group include a saturated aliphatic hydrocarbon group such as an n-butyl group, an isobutyl group, an s-butyl group, a t-butyl group, an n-pentyl group, a branched pentyl group, a secondary pentyl group, a tertiary pentyl group, an n-hexyl group, a branched hexyl group, a secondary hexyl group, a tertiary hexyl group, an n heptyl group, a branched heptyl group, a secondary heptyl group, a tertiary heptyl group, an n-octyl group, a 2-ethylhexyl group, a branched octyl group, a secondary octyl group, a tertiary octyl group, an n-nonyl group, a branched nonyl group, a secondary nonyl group, a tertiary nonyl group, an n-decyl group, a branched decyl group, a secondary decyl group, a tertiary decyl group, an n-undecyl group, a branched undecyl group, a secondary undecyl group, a tertiary undecyl group, an n-dodecyl group, a branched dodecyl group, a secondary dodecyl group, a tertiary dodecyl group, an n-tridecyl group, a branched tridecyl group, a secondary tridecyl group, a tertiary tridecyl group, an n-tetradecyl group, a branched tetradecyl group, a secondary tetradecyl group, a tertiary tetradecyl group, an n-pentadecyl group, a branched pentadecyl group, a secondary pentadecyl group, a tertiary pentadecyl group, an n-hexadecyl group, a branched hexadecyl group, a secondary hexadecyl group, a tertiary hexadecyl group, an n-heptadecyl group, a branched heptadecyl group, a secondary heptadecyl group, a tertiary heptadecyl group, an n-octadecyl group, a branched octadecyl group, a secondary octadecyl group, and a tertiary octadecyl group; an unsaturated aliphatic hydrocarbon group such as a 1-butenyl group, a 2-butenyl group, a 3-butenyl group, a 1-methyl-2-propenyl group, a 2-methyl-2-propenyl group, a 1-pentenyl group, a 2-pentenyl group, a 3-pentenyl group, a 4-pentenyl group, a 1-methyl-2-butenyl group, a 2-methyl-2-butenyl group, a 1-hexenyl group, a 2-hexenyl group, a 3-hexenyl group, a 4-hexenyl group, a 5-hexenyl group, a 1-heptenyl group, a 6-heptenyl group, a 1-octenyl group, a 7-octenyl group, an 8-nonenyl group, a 1-decenyl group, a 9-decenyl group, a 10-undecenyl group, a 1-dodecenyl group, a 4-dodecenyl group, an 11-dodecenyl group, a 12-tridecenyl group, a 13-tetradecenyl group, a 14-pentadecenyl group, a 15-hexadecenyl group, a 16-heptadecenyl group, a 1-octadecenyl group, and a 17-octadecenyl group; an aromatic hydrocarbon group such as a phenyl group, a toluyl group, a xylyl group, a cumenyl group, a mesityl group, a benzyl group, a phenethyl group, a styryl group, a cinnamyl group, a benzhydryl group, a trityl group, an ethylphenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, a dodecylphenyl group, a styrenated phenyl group, a p-cumylphenyl group, a phenylphenyl group, a benzylphenyl group, an α-naphthyl group, and a β-naphthyl group; and an alicyclic hydrocarbon group such as a cyclopropyl group, a cyclobutyl group, a cyclopentyl group, a cyclohexyl group, a cycloheptyl group, a cyclooctyl group, a methylcyclopentyl group, a methylcyclohexyl group, a methylcycloheptyl group, a methylcyclooctyl group, a 4,4,6,6-tetramethylcyclohexyl group, a 1,3-dibutylcyclohexyl group, a norbornyl group, a bicyclo[2.2.2]octyl group, an adamantyl group, a 1-cyclobutenyl group, a 1-cyclopentenyl group, a 3-cyclopentenyl group, a 1-cyclohexenyl group, a 3-cyclohexenyl group, a 3-cycloheptenyl group, a 4-cyclooctenyl group, a 2-methyl-3-cyclohexenyl group, and a 3,4-dimethyl-3-cyclohexenyl group. Among these, saturated aliphatic hydrocarbon groups and unsaturated aliphatic hydrocarbon groups are preferable, and saturated aliphatic hydrocarbon groups are more preferable because the effects of the Present invention can be more easily obtained. Further, a saturated aliphatic hydrocarbon group having 6 to 15 carbon atoms is more preferable, a saturated aliphatic hydrocarbon group having 8 to 13 carbon atoms is even more preferable, saturated aliphatic hydrocarbon groups having 8 and 13 carbon atoms are most preferable because the effects of the present invention are more easily obtained and the production is facilitated. Specifically, a 2-ethylhexyl group is preferable as the saturated aliphatic hydrocarbon group having 8 carbon atoms. Also, a branched tridecyl group is preferable as the saturated aliphatic hydrocarbon group having 13 carbon atoms.

Here, h represents a number from 3 to 10. Among these numbers, in order to realize a compound represented by the general formula (4) which makes it possible to easily obtain the effects of the present invention, h is preferably 4 to 7 and most preferably 7.

Further, n represents a number from 1 to 4. Among these numbers, in order to realize a compound represented by the general formula (4) which makes it possible to obtain easily the effect of the present invention, n is preferably 3 or 4 and most preferably 4.

In addition, the most preferable compound of general formula (4) will be explained in more detail using general formula (5) below:

$$Mo_3S_7\left[(\overset{\overset{\displaystyle S}{\|}}{C}NR^{51}R^{61})(\overset{\overset{\displaystyle S}{\|}}{C}NR^{52}R^{62})(\overset{\overset{\displaystyle S}{\|}}{C}NR^{53}R^{63})(\overset{\overset{\displaystyle S}{\|}}{C}NR^{54}R^{64})\right] \quad (5)$$

(wherein $R^{51}$ to $R^{54}$ each independently represent $R^5$ of the general formula (4), and $R^{61}$ to $R^{64}$ each independently represent $R^6$ of the general formula (4)).

$R^{51}$ to $R^{54}$ and $R^{61}$ of the general formula (5) may be the same or, different, but from the viewpoint of easily obtaining the effects of the present invention, it is preferable that a compound constituted by two or more types of hydrocarbon groups be present in the composition of the present invention, it is more preferable that a compound constituted by two types of hydrocarbon groups be present. It is even more preferable that a compound constituted by a mixture of a saturated aliphatic hydrocarbon group having 8 carbon atoms and a saturated aliphatic hydrocarbon group having 13 carbon atoms be present, and it is even more preferable that a compound constituted by a mixture of a saturated aliphatic hydrocarbon group having 8 carbon atoms and a saturated aliphatic hydrocarbon group having 13 carbon atoms wherein the groups bonded to the same nitrogen are the same hydrocarbon groups be present. Specifically, a 2-ethylhexyl group is preferable as the saturated aliphatic hydrocarbon group having 8 carbon atoms, and a branched tridecyl group is preferable as the saturated aliphatic hydrocarbon group having 13 carbon atoms.

In the case where $R^{51}$ to $R^{54}$ and $R^{61}$ to $R^{64}$ of the general formula (5) are constituted by two or more types of hydrocarbon groups, several compounds represented by the general formula (5) are mixed. A mixture of compounds represented by the general formula (5) in which $R^{51}$ to $R^{54}$ and $R^{61}$ to $R^{64}$ of the general formula (5) are constituted by two types of hydrocarbon groups is preferable, a mixture of compounds represented by the general formula (5) in which the groups bonded to the same nitrogen are the same hydrocarbon group (for example, a compound represented by the general formula (5) in which $R^{51}=R^{61}=R^{52}=R^{62}=R^{53}=R^{63}=R^{54}=R^{64}$; a compound represented by the general formula (5) in which $R^{51}=R^{61}$, $R^{52}=R^{62}=R^{53}=R^{63}=R^{54}=R^{64}$, and $R^{51}\neq R^{51}$; and a compound represented by the general formula (5) in which $R^{51}=R^{61}=R^{52}=R^{62}$, $R^{53}=R^{63}=R^{54}=R^{64}$, and $R^{51}\neq R^{53}$) is more preferable, and a mixture of compounds represented by the general formula (5) in which the groups bonded to the same nitrogen are the same hydrocarbon group and are the saturated aliphatic hydrocarbon group having 8 carbon atoms or the saturated aliphatic hydrocarbon group having 13 carbon atoms (specifically, a compound represented by the general formula (5) in which all of $R^{51}$, $R^{61}$, $R^{52}$, $R^{62}$, $R^{53}$, $R^{63}$, $R^{54}$ and $R^{64}$ are saturated aliphatic hydrocarbon groups having 8 carbon atoms; a compound represented by the general formula (5) in which all of $R^{51}$, $R^{61}$, $R^{52}$, $R^{62}$, $R^{53}$, $R^{63}$, $R^{54}$ and $R^{64}$ are saturated aliphatic hydrocarbon groups having 13 carbon atoms; a compound represented by the general formula (5) in which $R^{51}$ and $R^{61}$ are saturated aliphatic hydrocarbon groups having 8 carbon atoms, and all of $R^{52}$, $R^{62}$, $R^{53}$, $R^{63}$, $R^{54}$ and $R^{64}$ are saturated aliphatic hydrocarbon groups having 13 carbon atoms; a compound represented by the general formula (5) in which $R^{51}$ and $R^{61}$ are saturated aliphatic hydrocarbon groups having 13 carbon atoms, and all of $R^{52}$, $R^{62}$, $R^{53}$, $R^{63}$, $R^{54}$ and $R^{64}$ are saturated aliphatic hydrocarbon groups having 8 carbon atoms; and a compound represented by the general formula (5) in which all of $R^{51}$, $R^{61}$, $R^{52}$ and $R^{62}$ are saturated aliphatic hydrocarbon groups having 8 carbon atoms and $R^{53}$, $R^{63}$, $R^{54}$ and $R^{64}$ are all saturated aliphatic hydrocarbon groups having 13 carbon atoms) is even more preferable because the effects of the present invention are more remarkably demonstrated. Specifically, in the mixture, the saturated aliphatic hydrocarbon group having 8 carbon atoms is preferably a 2-ethylhexyl group, and the Saturated aliphatic hydrocarbon group having 13 carbon atoms is preferably a branched tridecyl group. For example, a mixture of compounds of (B)-1, (B)-2, (B)-3, (B)-4 and (B)-5 in the following Examples is preferable.

The mixing ratio of several molybdenum dithiocarbamates mixed together when $R^{51}$ to $R^{54}$ and $R^{61}$ to $R^{64}$ of the general formula (5) are constituted by two types of hydrocarbon groups is not limited, but from the viewpoint of remarkably demonstrating the effects of the present invention, it is preferable that mixing be performed at a mass ratio of (the amount of Mo in the compound represented by the general formula (5) in which $R^{51}=R^{61}=R^{52}=R^{62}=R^{53}=R^{63}=R^{54}=R^{64}$):(the amount of Mo in the compound represented by the general formula (5) in which $R^{51}=R^{61}$, $R^{52}=R^{62}=R^{53}=R^{63}=R^{54}=R^{64}$, and $R^{51}\neq R^{52}$):(the amount of Mo in the compound represented by the general formula (5) in which $R^{51}=R^{61}=R^{52}=R^{62}$, $R^{53}=R^{63}=R^{54}=R^{64}$, and $R^{51}\neq R^{53}$):(the amount of Mo in the compound represented by the general formula (5) in which the hydrocarbon groups bonded to the same nitrogen are different hydrocarbon groups)=(5 to 30):(20 to 80):(15 to 50):0, more preferably (8 to 25):(30 to 70):(22 to 45):0, and even more preferably (10 to 15):(45 to 60):(30 to 40):0. The sum of the numerical values of the constituent components of the proportional equation is 100.

Furthermore, when $R^1$ to $R^4$ of the general formula (2) are constituted by a saturated aliphatic hydrocarbon group having 8 carbon atoms and a saturated aliphatic hydrocarbon group having 13 carbon atoms, but from the viewpoint of more remarkably demonstrating the effects of the present invention, it is preferable that mixing of several dithiocarbamate which are to be mixed, be performed at a mass ratio of (the amount of Mo in the compound represented by the general formula (5) in which all of $R^{51}$, $R^{61}$, $R^{52}$, $R^{62}$, $R^{53}$, $R^{63}$, $R^{54}$ and $R^{64}$ are saturated aliphatic hydrocarbon groups having 8 carbon atoms):(the amount of Mo in the compound represented by the general formula (5) in which all of $R^{51}$, $R^{61}$, $R^{52}$, $R^{62}$, $R^{53}$, $R^{63}$, $R^{54}$ and $R^{64}$ are saturated aliphatic hydrocarbon groups having 13 carbon atoms):(the amount of Mo in the compound represented by the general formula (5) in which $R^{51}$ and $R^{61}$ are saturated aliphatic hydrocarbon groups having 8 carbon atoms and all of $R^{52}$, $R^{62}$, $R^{53}$, $R^{63}$, $R^{54}$, and $R^{64}$ are saturated aliphatic hydrocarbon groups having 13 carbon atoms):(the amount of Mo in the compound represented by the general formula (5) in which $R^{51}$ and $R^{61}$ are saturated aliphatic hydrocarbon groups having 13 carbon atoms and all of $R^{52}$, $R^{62}$, $R^{53}$, $R^{63}$, $R^{54}$ and $R^{64}$ are saturated aliphatic hydrocarbon groups having 8 carbon atoms):(the amount of Mo in the compound represented by the general formula (5) in which all of $R^{51}$, $R^{61}$, $R^{52}$, and $R^{62}$ are saturated aliphatic hydrocarbon groups having 8 carbon atoms and all of $R^{53}$, $R^{63}$, $R^{54}$, and $R^{64}$ are saturated aliphatic hydrocarbon groups having 13 carbon atoms):(the amount of Mo in the compound represented by the general formula (5) in which the hydrocarbon groups bonded to the same nitrogen are different groups)=(2 to 10):(2 to 10):(10 to 50):(10 to 50):(10 to 60) more preferably (4 to 8):(4 to 8):(15 to 35):(15 to 35):(20 to 45):0, and even more preferably (5 to 7):(5 to 7):(20 to 30):(20 to 30):(30 to 40):0, The sum of the numerical values of the constituent components of the proportional equation is 100.

Specifically, the mass ratio of (the amount of Mo in the compound (B)-1 of the following Examples):(the amount of Mo in the compound of (B)-2 in the following Examples):(the amount of Mo in the compound of (B)-3 in the following Examples):(the amount of Mo in the compound (B)-4 of the following Examples):(the amount of Mo in the compound (B)-5 of the following Examples) is preferably (2 to 10):(2 to 10):(10 to 50):(10 to 50):(10 to 60), more preferably (4 to 8):(4 to 8):(15 to 35):(15 to 35):(20 to 45), and even more preferably (5 to 7):(5 to 7):(20 to 30):(20 to 30):(30 to 40). The sum of the numerical values of the constituent components of the proportional equation is 100.

Further, the compound represented by the general formula (4) which is used in the present invention can be produced by a known production method.

The combination of the binuclear molybdenum compound (A) and the trinuclear molybdenum compound (B) used in the lubricant composition of the present invention is not limited, but from the viewpoint of easily obtaining the effects of the present invention, a combination of a compound in which the binuclear molybdenum compound (A) is represented by the general formula (1) and a compound in which the trinuclear molybdenum compound (B) is represented by the general formula (3) is preferable, a combination of a compound in which the binuclear molybdenum compound (A) is a molybdenum dithiocarbamate represented by the general formula (2) and a compound in which the trinuclear molybdenum compound (B) is represented by the general formula (4) is more preferable, and it is most preferable that in these combinations, $R^1$ to $R^4$ in the general formula (2) and $R^5$ and $R^6$ in the general formula (4) be independently from each other either a saturated aliphatic hydrocarbon group having 8 carbon atoms or a saturated aliphatic hydrocarbon group having 13 carbon atoms. Specifically, in the mixture, the saturated aliphatic hydrocarbon group having 8 carbon atoms is preferably a 2-ethylhexyl group, and the saturated aliphatic hydrocarbon group having 13 carbon atoms is preferably a branched tridecyl group.

The lubricant composition of the present invention includes a binuclear molybdenum compound (A) and a trinuclear molybdenum compound (B), and the effects of the present invention are exhibited for the first time as a result of using the two compounds together under the condition that the amounts of molybdenum contained in the two compounds are at certain specific mass ratio. That is, the mass ratio of molybdenum of the binuclear molybdenum compound (A) to molybdenum of the trinuclear molybdenum compound (B) is important, and the effect of the present invention cannot be obtained unless the compounds are blended so that the mass ratio of molybdenum of the binuclear molybdenum compound (A) and molybdenum of the trinuclear molybdenum compound (B) is such that (molybdenum of the binuclear molybdenum compound (A)):(molybdenum of the trinuclear molybdenum compound (B))=99.98:0.02 to 95:5. In other words, the desired effects of the present invention are demonstrated by a lubricant composition including the aforementioned compounds in amounts controlled to a range in which molybdenum of the trinuclear molybdenum compound (B) constitutes 0.02% by mass to 5% by mass with respect to the total amount of molybdenum of the binuclear molybdenum compound (A) and molybdenum of the trinuclear molybdenum compound (B).

Among them, from the viewpoint of easily obtaining the effects of the present invention, the mass ratio of molybdenum of the binuclear molybdenum compound (A) and molybdenum of the trinuclear molybdenum compound (B) is more preferably (molybdenum of the binuclear molybdenum compound (A)):(molybdenum of the trinuclear molybdenum compound (B))=99.98:0.02 to 97:3, even more preferably 99.75:0.25 to 97:3, and most preferably 99.75:0.25 to 98.5:1.5. Where molybdenum of the trinuclear molybdenum compound (B) is blended in an amount less than that represented by the ratio of (molybdenum of the binuclear molybdenum compound (A)):(molybdenum of the trinuclear molybdenum compound (B))=99.98:0.02, good friction reducing effect cannot be obtained, and where molybdenum of the trinuclear molybdenum compound (B) is blended in an amount more than that represented by the ratio of (molybdenum of the binuclear molybdenum compound (A)):(molybdenum of the trinuclear molybdenum compound (B))=95:5, solubility in a base oil and oxidation stability of the oil are remarkably deteriorated, and the sustainability of the friction reducing effect is deteriorated.

The lubricating oil composition of the present invention is obtained by adding the lubricant composition of the present invention to a base oil. In order to add the lubricant composition of the present invention to the base oil and exert the effects of the present invention, it is preferable that the total amount of molybdenum of the binuclear molybdenum compound (A) and molybdenum of the trinuclear molybdenum compound (B) be 50 mass ppm to 5000 mass ppm, more preferably 80 mass ppm to 4000 mass ppm, even more preferably 100 mass ppm to 2000 mass ppm, and still more preferably 100 mass ppm to 1500 mass ppm as the amount of molybdenum with respect to the lubricating oil composition including the base oil and the additive. In particular, when the lubricating oil composition is to be used in expectation of a friction reducing effect, the total amount is most preferably 500 ppm to 1000 ppm, and when the lubricating oil composition is to be used in expectation of antioxidation performance, the total amount is most preferably 100 ppm to 500 ppm. Where the total amount of molybdenum is less than 50 ppm, the friction reducing effect may not be observed, and where the total amount of molybdenum is more than 5000 ppm, a friction reducing effect commensurate with the addition amount may not be obtained and the solubility in the base oil may be remarkably deteriorated.

The base oil of the usable lubricating oil composition is not particularly limited and may be appropriately selected from mineral base oils, chemically synthesized base oils, animal and vegetable base oils, mixed base oils thereof, and the like, depending on the intended use and conditions. Here, examples of the mineral base oil include paraffin-based crude oils, naphthene-based crude oils, intermediate-based crude oils, aromatic-based crude oils, distillate oils obtained by normal-pressure distillation of these crude oils, distillate oils obtained by vacuum distillation of residual oils obtained by normal-pressure distillation, and refined oils obtained by refining the aforementioned oils by the usual methods, specifically refined oils obtained by solvent refining, hydrogenation refined oils, oils obtained by dewaxing treatment, and white clay-treated oils.

Examples of the chemically synthesized base oils include poly olefins, polyisobutylene (polybutene), monoesters, diesters, polyol esters, silicic acid esters, polyalkylene glycols, polyphenyl ethers, silicones, fluorinated compounds, alkylbenzenes and GTL, base oil. Among them, poly-α-olefins, polyisobutylene (polybutene), diesters, polyol esters and the like can be widely used. Poly-α-olefins can be exemplified by polymerization or oligomerization products of 1-hexene, 1-octene, 1-nonene, 1-decene, 1-dodecene, 1-tetradecene or the like, or hydrogenated products thereof. Examples of diesters include diesters of dibasic acids such as glutaric acid, adipic acid, azelaic acid, sebacic acid, dodecanedioic acid and the like and alcohols such as 2-ethylhexanol, octanol, decanol, dodecanol, tridecanol and the like. Examples of polyol esters include esters of polyols such as neopentyl glycol, trimethylol ethane, trimethylol propane, pentaerythritol, dipentaerythritol, tripentaerythritol and the like with fatty acids such as caproic acid, caprylic acid, lauric acid, capric acid, myristic acid, palmitic acid, stearic acid, oleic acid and the like.

Examples of animal and vegetable base oils include vegetable fats and oils such as castor oil, olive oil, cocoa butter, sesame oil, rice bran oil, safflower oil, soybean oil, camellia oil, corn oil, rapeseed oil, palm oil, palm kernel oil, sunflower oil, cottonseed oil and coconut oil, and animal fats and oils such as beef tallow, lard, milk fat, fish oil and whale oil. These various base oils listed above may be used singly or in combination of two or more types as appropriate. Further, from the viewpoint of easily obtaining the effects of the present invention, it is preferable to use a mineral base oil and a chemically synthesized base oil, and it is more preferable to use a mineral base oil.

The lubricating oil composition of the present invention is obtained by adding the lubricant composition of the present invention to a base oil, but the effects of the present invention are obtained as a result of using molybdenum of the binuclear molybdenum compound (A) together with the molybdenum compound of the trinuclear molybdenum compound (B) at a certain specific mass ratio. Therefore, the form of adding the binuclear molybdenum compound (A) and the trinuclear molybdenum compound (B) to the base oil is not particularly limited, and these may be previously mixed and added as a lubricant composition at the same time, or the binuclear molybdenum compound (A) and the trinuclear molybdenum compound (B) may be added separately.

The lubricating oil composition of the present invention can appropriately use, depending on the purpose of use, well-known lubricating oil additives as long as the effects of the present invention are not impaired, examples of the additives including a metal-base detergent, an ashless dispersant, an antiwear agent, an antioxidant, a viscosity index improver, a pour point depressant, a rust inhibitor, a corrosion inhibitor, a metal deactivator and an antifoaming agent. One or two or more of these additives may be used.

The lubricating oil composition of the present invention can be used as a lubricating oil for vehicles (for example, gasoline engine oils, diesel engine oils and the like for automobiles, motorcycles, and the like), and industrial lubricating oils (for example, gear oil, turbine oil, oil film bearing oil, lubricating oils for refrigerators, vacuum pump oil, lubricating oils for compression, multipurpose lubricating oil, and the like). Among them, from the viewpoint of maximizing the effects of the present invention and making it possible to easily obtain the effects, the lubricating oil composition of the present invention is preferably used as lubricating oil for vehicles, and more preferably for gasoline engine oil.

EXAMPLES hereinafter, the present invention will be specifically described with reference to Examples, but the present invention is not limited by these examples at all.

Binuclear Molybdenum Compound (A) Used in Examples and Comparative Examples

A mixture of a binuclear molybdenum compound (A)-1 represented by the general formula (2) in which $R^1=R^2=R^3=R^4=C_8H_{17}$, $X^1$ and $X^2=S$, $X^3$ and $X^4=O$, a binuclear molybdenum compound (A)-2 represented by the general formula (2) in which $R^1=R^2=R^3=R^4=C_{13}H_{27}$, $X^1$ and $X^2=S$, $X^3$ and $X^4=O$, and a binuclear molybdenum compound (A)-3 represented by the general formula (2) in which $R^1=R^2=C_8H_{17}$, $R^3=R^4=C_{13}H_{27}$, $X^1$ and $X^2=S$, $X^3$ and $X^4=O$ (The $C_8H_{17}$ is a 2-ethylhexyl group, the $C_{13}H_{27}$ is a branched tridecyl group, the mass ratio of (the amount of Mo in the compound (A)-1):(the amount of Mo in the compound (A)-2):(the amount of Mo in the compound (A)-3) is 25:25:50.)

Trinuclear Molybdenum Compound (B) Used in Examples and Comparative Examples A mixture of a trinuclear molybdenum compound (B)-1 represented by the general formula (5) in which $R^{51}=R^{61}=R^{52}=R^{62}=R^{53}=R^{63}=R^{54}=R^{64}=C_8H_{17}$, a trinuclear molybdenum compound (B)-2 represented by the general formula (5) in which $R^{51}=R^{61}=R^{51}=R^{62}=R^{53}=R^{63}=R^{54}=R^{64}=C_{13}H_{27}$, a trinuclear molybdenum compound (B)-3 represented by the general formula (5) in which $R^{51}=R^{61}=C_8H_{17}$, $R^{52}=R^{62}=R^{53}=R^{63}=R^{54}=R^{64}=C_{13}H_{27}$, a trinuclear molybdenum compound (B)-4 represented by the general formula (5) in which $R^{51}=R^{61}=C_{13}H_{27}$, $R^{52}=R^{62}=R^{53}=R^{63}=R^{54}=R^{64}=C_8H_{17}$, and a trinuclear molybdenum compound (B)-5 represented by the general formula (5) in which $R^{51}=R^{61}=R^{52}=R^{62}=C_8H_{17}$, $R^{53}=R^{63}=R^{54}=R^{64}=C_{13}H_{27}$ (The $C_8H_{17}$ is a 2-ethylhexyl group, the $C_{13}H_{27}$ is a branched tridecyl group, the mass ratio of (the amount of Mo in the compound (B)-1):(the amount of Mo in the compound (B)-2):(the amount of Mo in the compound (B)-3):(the amount of Mo in the compound (B)-4):(the amount of Mo in the compound (B)-5) is 6.25:6.25:25:25:37.5.)

Example Products and Comparative Products

Lubricant compositions 1 to 13 (Example Products 1 to 8 and Comparative Products 1 to 5) were obtained by using the abovementioned binuclear molybdenum compounds (A) and trinuclear molybdenum compound (B) and blending, the compounds so as to obtain the mass ratios of molybdenum of the binuclear molybdenum compound (A) to molybdenum of the trinuclear molybdenum compound (B) as shown in Table 1.

TABLE 1

| | Lubricant composition | Amount of molybdenum derived from binuclear molybdenum compound (A) | Amount of molybdenum derived from trinuclear molybdenum compound (B) |
|---|---|---|---|
| Example 1 | Lubricant composition 1 | 99.98 | 0.02 |
| Example 2 | Lubricant composition 2 | 99.9 | 0.1 |
| Example 3 | Lubricant composition 3 | 99.75 | 0.25 |
| Example 4 | Lubricant composition 4 | 99.5 | 0.5 |
| Example 5 | Lubricant composition 5 | 99 | 1 |
| Example 6 | Lubricant composition 6 | 98.5 | 1.5 |
| Example 7 | Lubricant composition 7 | 97 | 3 |
| Example 8 | Lubricant composition 8 | 95 | 5 |
| Comparative Example 1 | Lubricant composition 9 | 92 | 8 |
| Comparative Example 2 | Lubricant composition 10 | 90 | 10 |
| Comparative Example 3 | Lubricant composition 11 | 85 | 15 |
| Comparative Example 4 | Lubricant composition 12 | 99.99 | 0.01 |
| Comparative Example 5 | Lubricant composition 13 | 100 | 0 |

(Units: mass ratio)

<Solubility Test>

A solubility test was carried out using the abovementioned lubricant compositions. Lubricant compositions 1, 2, 3, 5, and 7 to 13 were blended with a group I mineral oil having a kinematic viscosity at 40° C. of 22.7 $mm^2/s$, a kinematic viscosity at 100° C. of 4.39 $mm^2/s$ and a viscosity index VI of 102 so that the total molybdenum amount was 200 ppm to obtain lubricating oil compositions 1 to 11. After dissolving at 60° C. under stirring, the temperature was returned to room temperature (25° C.) and the compositions were allowed to stand for one day. The results are shown in Table 2.

TABLE 2

| | Lubricant composition used | Lubricating oil composition | Solubility in base oil |
|---|---|---|---|
| Example 9 | Lubricant composition 1 | Lubricating oil composition 1 | Dissolves |
| Example 10 | Lubricant composition 2 | Lubricating oil composition 2 | Dissolves |
| Example 11 | Lubricant composition 3 | Lubricating oil composition 3 | Dissolves |
| Example 12 | Lubricant composition 5 | Lubricating oil composition 4 | Dissolves |
| Example 13 | Lubricant composition 7 | Lubricating oil composition 5 | Dissolves |

TABLE 2-continued

| | Lubricant composition used | Lubricating oil composition | Solubility in base oil |
|---|---|---|---|
| Example 14 | Lubricant composition 8 | Lubricating oil composition 6 | Dissolves |
| Comparative Example 6 | Lubricant composition 9 | Lubricating oil composition 7 | Precipitates are present |
| Comparative Example 7 | Lubricant composition 10 | Lubricating oil composition 8 | Precipitates are present |
| Comparative Example 8 | Lubricant composition 11 | Lubricating oil composition 9 | Precipitates are present |
| Comparative Example 9 | Lubricant composition 12 | Lubricating oil composition 10 | Dissolves |
| Comparative Example 10 | Lubricant composition 13 | Lubricating oil composition 11 | Dissolves |

As a result, it was found that when the mass ratio of molybdenum of the binuclear molybdenum compound (A) to molybdenum of the trinuclear molybdenum compound (B) was 92:8, 90:10, and 85:15, precipitation occurred.

<Oxidation Stability Test>

An oxidation stability test was then carried out. In this case, measurement of pressure DSC (PDSC) was used as a method for directly evaluating oxidation stability. PDSC stands for High-Pressure Differential Scanning calorimetry, and indicates high-pressure differential scanning calorimetry. By this measurement, the oxidation induction period can be determined, and the degree of deterioration of the oil can be measured.

The measurement conditions in the present investigation were as follows.

Measuring instrument: Pressure DSC DSC 2920 (manufactured by TA Instruments)

Temperature: 180° C.

Pressure: 690 kPa

Atmosphere: air

Evaluation oil amount: 3 mg

Lubricant compositions 1, 2, 3, 5, and 7 to 13 were blended with a group III mineral oil having a kinematic viscosity at 40° C. of 19.5 $mm^2/s$, a kinematic viscosity at 100° C. of 4.24 $mm^2/s$ and a viscosity index VI of 124 so that the total molybdenum amount was 500 ppm to prepare lubricating oil compositions 12 to 22 to be used for measurements. In this case, under the above measurement conditions, samples having an oxidation induction period of less than 40 min were determined to have poor oxidation stability and failed the test. In this test, specifications of the testing machine made it is also possible to measure samples in which precipitation has occurred, and the evaluation was carried out without concern about the presence or absence of precipitation.

TABLE 3

| | Lubricant composition used | Lubricating oil composition | Oxidation stability |
|---|---|---|---|
| Example 15 | Lubricant composition 1 | Lubricating oil composition 12 | Passed the test |
| Example 16 | Lubricant composition 2 | Lubricating oil composition 13 | Passed the test |

TABLE 3-continued

| | Lubricant composition used | Lubricating oil composition | Oxidation stability |
|---|---|---|---|
| Example 17 | Lubricant composition 3 | Lubricating oil composition 14 | Passed the test |
| Example 18 | Lubricant composition 5 | Lubricating oil composition 15 | Passed the test |
| Example 19 | Lubricant composition 7 | Lubricating oil composition 16 | Passed the test |
| Example 20 | Lubricant composition 8 | Lubricating oil composition 17 | Passed the test |
| Comparative Example 11 | Lubricant composition 9 | Lubricating oil composition 18 | Failed the test |
| Comparative Example 12 | Lubricant composition 10 | Lubricating oil composition 19 | Failed the test |
| Comparative Example 13 | Lubricant composition 11 | Lubricating oil composition 20 | Failed the test |
| Comparative Example 14 | Lubricant composition 12 | Lubricating oil composition 21 | Passed the test |
| Comparative Example 15 | Lubricant composition 13 | Lubricating oil composition 22 | Passed the test |

As a result, it was found that when the mass ratio of molybdenum of the binuclear molybdenum compound (A) to molybdenum of the trinuclear molybdenum compound (B) was 92:8, 90:10, and 85:15, the samples failed the test.

<Lubricating Property Test>

Subsequently, a lubricating property test was conducted. Lubricating oil compositions 1 to 11, 23, and 24 obtained by blending lubricant compositions 1 to 13 with a group I mineral oil having a kinematic: viscosity at 40° C. of 22.7 $mm^2/s$, a kinematic viscosity at 100° C. of 4.39 $mm^2/s$ and a viscosity index VI of 102 so that the total molybdenum amount was 200 ppm were used as test samples. The test was carried out by a line contact method (Cylinder on Disk) under the following conditions by using an SRV testing machine (manufacturer name: Optimal Instruments Prüftechnik GmbH, model: type 3), and the friction coefficient was evaluated. The lubricating oil compositions 7 to 9 using the lubricant compositions 9 to 11 in which the mass ratio of molybdenum of the binuclear molybdenum compound (A) to molybdenum of the trinuclear molybdenum compound (B) was 92:8, 90:10, and 85:15 could not be evaluated because solubility in the base oil was poor and precipitation occurred.

| | Test Conditions |
|---|---|
| Load | 200N |
| Amplitude | 1.0 mm |
| Frequency | 50 Hz |
| Temperature | 80° C. |
| Time | 15 min |

The measured values of the friction coefficient are shown in Table 4, and the plotted relationship between the mass ratio of molybdenum of the trinuclear molybdenum compound (B) and the friction coefficient is shown in FIG. 1.

TABLE 4

| | Lubricant composition used | Lubricating oil composition | Friction coefficient |
|---|---|---|---|
| Base oil | — | — | 0.188 |
| Example 21 | Lubricant composition 1 | Lubricating oil composition 1 | 0.118 |
| Example 22 | Lubricant composition 2 | Lubricating oil composition 2 | 0.119 |
| Example 23 | Lubricant composition 3 | Lubricating oil composition 3 | 0.106 |
| Example 24 | Lubricant composition 4 | Lubricating oil composition 23 | 0.100 |
| Example 25 | Lubricant composition 5 | Lubricating oil composition 4 | 0.102 |
| Example 26 | Lubricant composition 6 | Lubricating oil composition 24 | 0.104 |
| Example 27 | Lubricant composition 7 | Lubricating oil composition 5 | 0.106 |
| Example 28 | Lubricant composition 8 | Lubricating oil composition 6 | 0.108 |
| Comparative Example 16 | Lubricant composition 9 | Lubricating oil composition 7 | Could not be measured |
| Comparative Example 17 | Lubricant composition 10 | Lubricating oil composition 8 | Could not be measured |
| Comparative Example 18 | Lubricant composition 11 | Lubricating oil composition 9 | Could not be measured |
| Comparative Example 19 | Lubricant composition 12 | Lubricating oil composition 10 | 0.140 |
| Comparative Example 20 | Lubricant composition 13 | Lubricating oil composition 11 | 0.141 |

As a result, it was found that where a lubricant composition in which the mass ratio of molybdenum of the binuclear molybdenum compound (A) to molybdenum of the trinuclear molybdenum compound (B) is (molybdenum of the binuclear molybdenum compound (A)):(molybdenum of the trinuclear molybdenum compound (B))=99.98:0.02 to 95:5 was used, a good friction reducing effect was obtained, and even better friction reducing effect was obtained with the lubricant composition with (molybdenum of the binuclear molybdenum compound (A)):(molybdenum of the trinuclear molybdenum compound (B))=99.75:0.2 to 97:3.

INDUSTRIAL APPLICABILITY

With the present invention, a lubricant composition exhibiting good solubility in a base oil, good oxidation stability, and a good friction reducing effect can be provided by setting the mass ratio of molybdenum of a binuclear molybdenum compound (A) and molybdenum of a trinuclear molybdenum compound (B) to a range of (molybdenum of a binuclear molybdenum compound (A)):(molybdenum of a trinuclear molybdenum compound (B))=99.98:0.02 to 95:5, The demand for improved friction reducing properties has been rising not only in the field of lubricating oils for vehicles but also in every field of industrial lubricating oils, and the present invention can be expected to be successfully used in these various applications. Therefore, the present invention has very high utility.

The invention claimed is:

1. A lubricant composition comprising a binuclear molybdenum compound (A) and a trinuclear molybdenum compound (B), wherein these compounds are included in a range represented by (molybdenum of the binuclear molybdenum compound (A)):(molybdenum of the trinuclear molybdenum compound (B))=99.98:0.02 to 95:5 as a mass ratio, and wherein the binuclear molybdenum compound (A) is a molybdenum dithiocarbamate represented by the following formula (2) and the trinuclear molybdenum compound (B) is a compound represented by the following formula (4):

(2)

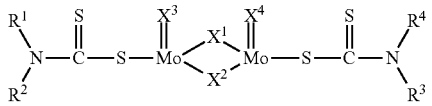

wherein $R^1$ to $R^4$ each independently represent a hydrocarbon group having 4 to 18 carbon atoms, and $X^1$ to $X^4$ each independently represent a sulfur atom or an oxygen atom;

(4)

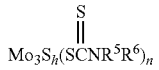

wherein $R^5$ and $R^6$ each independently represent a hydrocarbon group having 4 to 18 carbon atoms, h represents a number from 3 to 10, and n represents a number from 1 to 4.

2. A lubricating oil composition comprising, in a base oil, the lubricant composition of claim 1 in a molybdenum amount of 50 mass ppm to 5000 mass ppm.

3. A method for improving a friction reducing effect of a lubricating oil composition, the method comprising adding a binuclear molybdenum compound (A) and a trinuclear molybdenum compound (B) to a base oil which is to be used in the lubricating oil composition, wherein molybdenum of the binuclear molybdenum compound (A) and molybdenum of the trinuclear molybdenum compound (B) are added in a range represented by 99.98:0.02 to 95:5 as a mass ratio, and wherein the binuclear molybdenum compound (A) is a molybdenum dithiocarbamate represented by the following formula (2) and the trinuclear molybdenum compound (B) is a compound represented by the following formula (4):

(2)

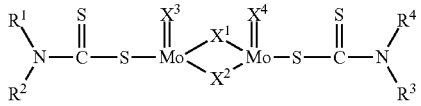

wherein $R^1$ to $R^4$ each independently represent a hydrocarbon group having 4 to 18 carbon atoms, and $X^1$ to $X^4$ each independently represent a sulfur atom or an oxygen atom;

(4)

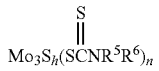

wherein $R^5$ and $R^6$ each independently represent a hydrocarbon group having 4 to 18 carbon atoms, h represents a number from 3 to 10, and n represents a number from 1 to 4.

* * * * *